United States Patent [19]

Yang

[11] 4,261,187

[45] Apr. 14, 1981

[54] OSCILLATION DAMPING AND COUNTERPOISING CIRCULAR KNITTING MACHINE

[76] Inventor: Ping C. Yang, No. 73, Tao San St., Tao Yuan City, Taiwan

[21] Appl. No.: 934,612

[22] Filed: Aug. 17, 1978

[51] Int. Cl.[3] ..... D04B 9/06; D04B 15/88; D04B 35/00

[52] U.S. Cl. ..... 66/28; 66/8; 66/147; 66/151

[58] Field of Search ..... 66/8, 28, 147, 149 R, 66/151, 153

[56] References Cited

U.S. PATENT DOCUMENTS

| | | | |
|---|---|---|---|
| 417,382 | 12/1889 | Carr | 66/28 |
| 2,261,349 | 11/1941 | Edelman | 66/8 X |
| 3,222,889 | 12/1965 | Mishcon | 66/28 |
| 3,521,466 | 7/1970 | Tannert | 66/153 X |
| 3,525,240 | 8/1970 | Piana et al. | 66/147 |

FOREIGN PATENT DOCUMENTS

| | | | |
|---|---|---|---|
| 51-102152 | 9/1976 | Japan | 66/151 |
| 1826 | of 1858 | United Kingdom | 66/8 |

*Primary Examiner*—Wm. Carter Reynolds
*Attorney, Agent, or Firm*—Shoemaker and Mattare, Ltd.

[57] ABSTRACT

The present invention relates to an oscillation damping and counterpoising circular knitting machine, particularly to a circular knitting machine wherein the distance between the pinion or the belt pulley and each latch needle is comparatively lengthened or an oscillation damping means further provided whereby the oscillation which would bring about undesired horizontal lines upon the knitted fabric is counterpoised and meantime greatly decreased.

2 Claims, 10 Drawing Figures

OSCILLATION DAMPING AND COUNTERPOISING CIRCULAR KNITTING MACHINE

BACKGROUND OF THE INVENTION

Generally, the conventional circular knitting machine employs a driving pinion to engage with a gear wheel, at the central portion of the latter there being no provision of shaft. Due to the clearance between the teeth of the pinion and those of the gear wheel, an oscillation would by all means be brought about. And each time when any of the latch needles rotates to the position where it is relatively most close to the oscillation source, the oscillation grows greater, whereas each time when any of the latch needles rotates to the position where it is relatively farthest from the oscillation source, the oscillation shrinks. Therefore, upon the surface of the knitted fabric, there would occur the undesired horizontal lines. Aside from the unequal oscillation, of course there are still another causes, such as the quality of yarns, the adjustment of cam etc which also would bring about the undesired horizontal lines. Nevertheless, these causes may more easily be controlled than the unequal oscillation and have hereinto been controlled. To prove that the undesired horizontal lines derive themself from the unequal oscillation, the inventor has taken the circular knitting machine of 38 gauge to make an experiment therewith. On the one hand, smear the dye on a yarn entrance of one transmission assembly which is most close to the oscillation source, i.e. the engagement point between a gear wheel and a pinion so that when the yarn is entered, the dye will be attached thereto. As a result, the knitted fabric reveal that there is the dyed track on the thick horizontal lines thereof. On the other hand, repeat the same experiment at another transmission assembly which is provided at the opposite position of said transmission assembly, the dyed track also is seen occurring on the thin horizontal lines thereof. To obtain a further proof thereof, the inventor removes the secondly mentioned transmission assembly and then finds that the thin horizontal lines disappear. Therefore, the fact finds itself true that the longer the oscillation goes, the denser would be the undesired horizontal lines.

SUMMARY OF THE INVENTION

The device embodying the teachings of the present invention includes a machine truss having an active hollow shaft and a passive hollow shaft mounted thereon. A gear wheel is driven by a pinion which, in turn, is driven by a motor to drive a transmission ring secured on one end of the active central hollow shaft. A circular latch needle plate is secured to the active shaft and an upper circular latch needle plate is secured to the passive shaft. A plurality of latch needles are provided on the lower latch plate and a bearing transmission assembly is provided between the upper and lower latch needle plates.

The oscillation occurring between the gear wheel and the pinion passes through a driving bracket, the transmission ring, the latch needle cylinder and finally to the tip of each latch needle so that the oscillation is radially dispersed to each latch needle and is also greatly decreased.

The main object of the invention is to improve the conventional circular knitting machine.

Another object of the invention is to provide an oscillation damping and equilibrating circular knitting machine whereby the undesired horizontal and vertical lines are obviated.

BRIEF DESCRIPTION OF THE DRAWING

The above and other features, objects and advantages of the invention will become apparent from the following detailed description taken together with the drawings, wherein.

DETAILED DESCRIPTION OF THE INVENTION

Figure 1:
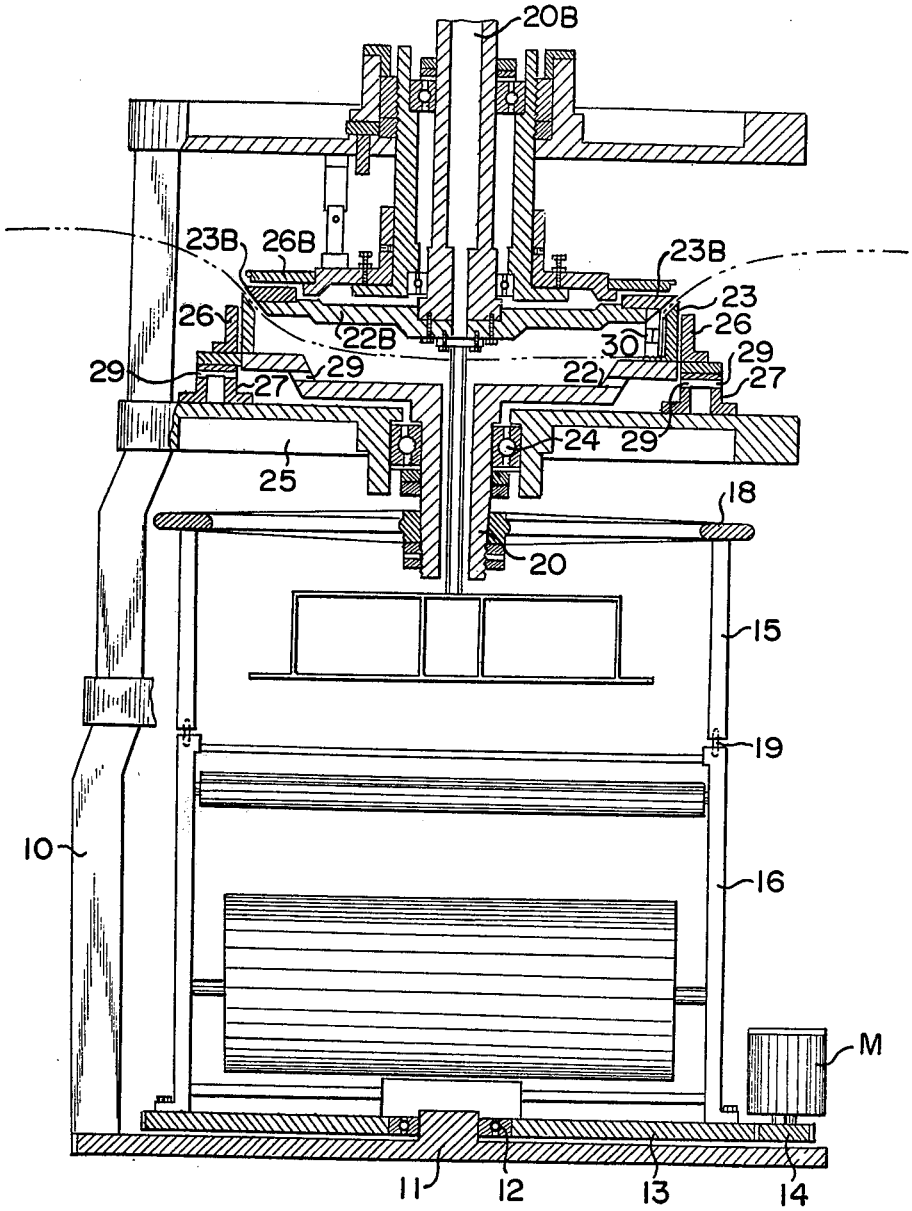
FIG. 1 is a longitudinal cross-sectional view through a first and a second embodiment of the invention, wherein the former is the portion under the phantom line, while the later includes the portions under and above the phantom line.

As shown in FIG. 1, the portion under the phantom line is a single circular knitting machine with a single shaft, being a first embodiment of the invention. Upon a base 11 of a machine truss 10, a gear wheel 13 is pivoted by means of a bearing 12. Said gear wheel 13 is in mesh with a pinion 14 so that when driven by a motor M, the pinion 14 will drive the gear wheel 13 to rotate. At both sides of said gear wheel 13, there are provided an upper driving bracket 15 and a lower driving bracket 16, both being connected together by means of movable pins 19—19. Also as shown in FIG. 1, said upper driving bracket 15 is fixed on to beneath a transmission ring 18, while said lower driving bracket 16 is fixed on to said gear wheel 13. (The cloth take-up roll shown in FIG. 1 is a conventional device and therefore it will not be described.) When said gear wheel 13 is driven, said transmission ring 18 will rotate by means of the transmission of said upper and lower driving brackets whereby a central hollow shaft 20 fixed on to said transmission ring 18 will rotate on the heels thereof. The shaft 20 thus forms an active central hollow shaft. Horizontally upon said central hollow shaft 20, a circular latch needle plate 22 is secured, upon the outer circumference thereof being provided a plurality of latch needles 23. Between the rim and the lower hub of said circular latch needle plate 22, there is further provided an inspection space 29. Said central hollow shaft 20 is provided within the central hole of a circular machine plate 25 by means of a bearing 24, said circular machine plate 25 being fixed on to said machine bracket 10. In abutment with the rim of said circular machine plate 25, cams 26 is provided. Between said cams 26 and said latch needle seat 22, an inspection space 29 is provided. It is noted in FIG. 1 that one inspection space 29 is defined between the lower hub and the upper rim of the lower circular latch needle plate and through and between the cams and cam seats. Therefore, taking advantage of a plurality of inspection spaces 29 which are formed in pairs, the operator can check the status of cloth inside said knitting machine. When said circular latch needle plate 22 is driven to rotate, said cams 26 will coordinate therewith to proceed the knitting. From above, it is easily seen that said gear wheel 13, and said pinion 14 are located at the bottom of the first embodiment of the invention and that the oscillation brought about between said gear wheel 13 and said pinion 14 go through a long distance-successively through said lower driving bracket 16, said upper driving bracket, said central hollow shaft 20, and further said circular latch needle plate 22 to the tips of said latch needles 23—23 where the magnitude of oscillation is decreased to the smallest. Besides, when the oscillation reaches at said central hollow shaft 20, it can be radially and equilibriumly distributed upon said latch needles whereby the equal magnitude of oscillation thereupon can obviate the undesired occurrence of horizontal line.

The fabric is drawn through the latch needles 23 and 23B whereby the fabric is being knitted into a cloth of cylindrical shape, which is gathered and drawn through the hollow space around the rod in the shaft 20 to the take up roll below, said rod being fixed to the lower, central portion of the latch needle plate 22B and provided with a fabric stretcher at its lower end, and with said stretcher the cloth drawn through the central hollow space in the shaft 20 is stretched for winding by the take-up roll. The size of the central hollow shaft 20 depends upon the thickness of the cloth to be knitted so that there is ample space between the inner surface of the shaft 20 and the outer surface of the rod in the shaft.

As shown in FIG. 1, the portions above and under the phantom line show an interlock circular knitting machine, being a second embodiment of the invention. In order for an upper knitting assembly and a lower knitting assembly to have a synchronous rotation, a transmission bearing line 30 is provided between a upper circular latch needle plate 23B and a lower latch needle plate 22.

Figure 2A:
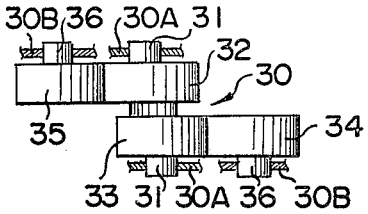
FIG. 2A is a top view of the bearing transmission device of the invention.
Figure 2B:
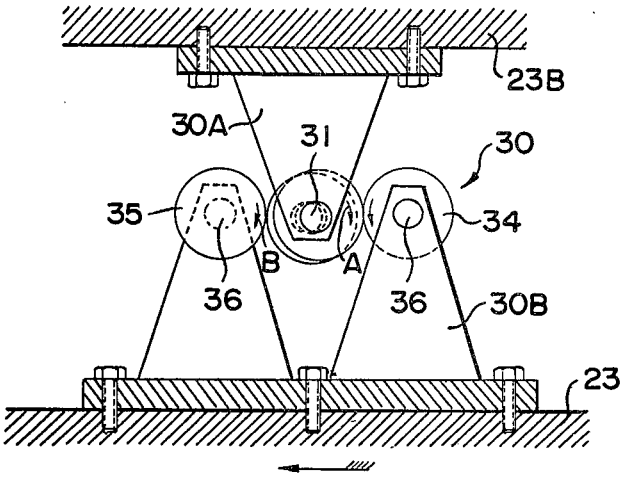
FIG. 2B is a front view of the bearing transmission device of the invention.

Because said central hollow shaft 20 is an active revolving shaft while upper central hollow shaft 20B (as shown in FIG. 1) is a passive revolving shaft, there is one set of bearing transmission devices 30 provided therebetween for synchronous revolving of both shafts as shown in FIGS. 2A and 2B, said bearing transmission device 30 comprises two transmission bearings 32 and 33 respectively pivoted upon two stationary eccentric axes 31—31 which are integrally formed and are fixed on to an upper supporting plate 30A secured on to the bottom surface of said upper circular latch needle plate 23B. Also as shown, said bearing transmission device further comprises a driving bearing 34 and a braking bearing 35 respectively disposed at both sides of said two transmission bearings 32 and 33, said driving bearing 34 and braking bearing 35 being fixed on to a lower supporting plate 30B respectively by means of two axes 36—36. Said two axes 36—36 are fixed on to a lower supporting plate 30B which is secured on to the surface of said circular latch needle plate 23. There is the provision of a small clearance between said transmission bearing 33 and said driving bearing 34 and likewise a small clearance is provided between said transmission bearing 32 and said braking bearing 35. Since said two transmission bearings 32 and 33 are respectively provided on said eccentrical axes 31—31, the knitting fabric may pass through said clearances and then go thereunder, during which said two transmission bearings 32–33 are transmitted to rotate thereby (as shown by arrows A and B in FIGS. 2A and 2B). Therefore, in addition to a function for said upper circular latch needle plate 23 and said lower circular latch needle plate 23B to have a synchronous rotation, said transmission bearing device 30 has another function for knitting fabric to pass therethrough. Since the conventional bearing transmission device thereof comprises four sets of driving bearings and one set of braking bearing, five undesired vertical lines will consequently be brought about. Since two friction forces are generated between said clearances respectively and are exerted on the knitting fabric, only two undesired vertical lines will occur on the knitted fabric by means of the present bearing transmission device but the distance between them is small, it requires only a simple way to insure the beauty of the knitted fabric that the knitted fabric is cut along the central line between said two vertical lines without losing its beauty because these undesired vertical lines are near the outer border of the knitted fabric.

Figure 4:
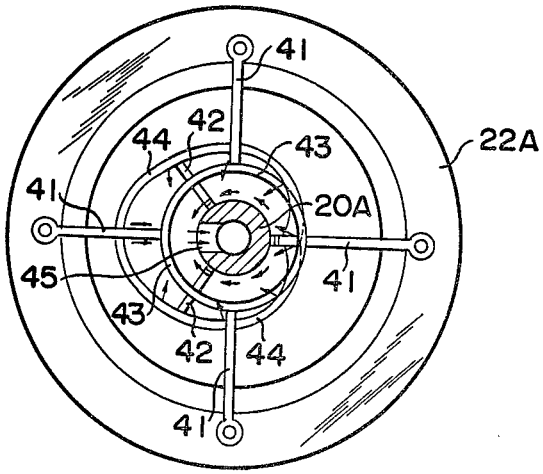
FIG. 4 is a top view to depict the distance adjusting steel rings of said third embodiment of the invention.
Figure 3:
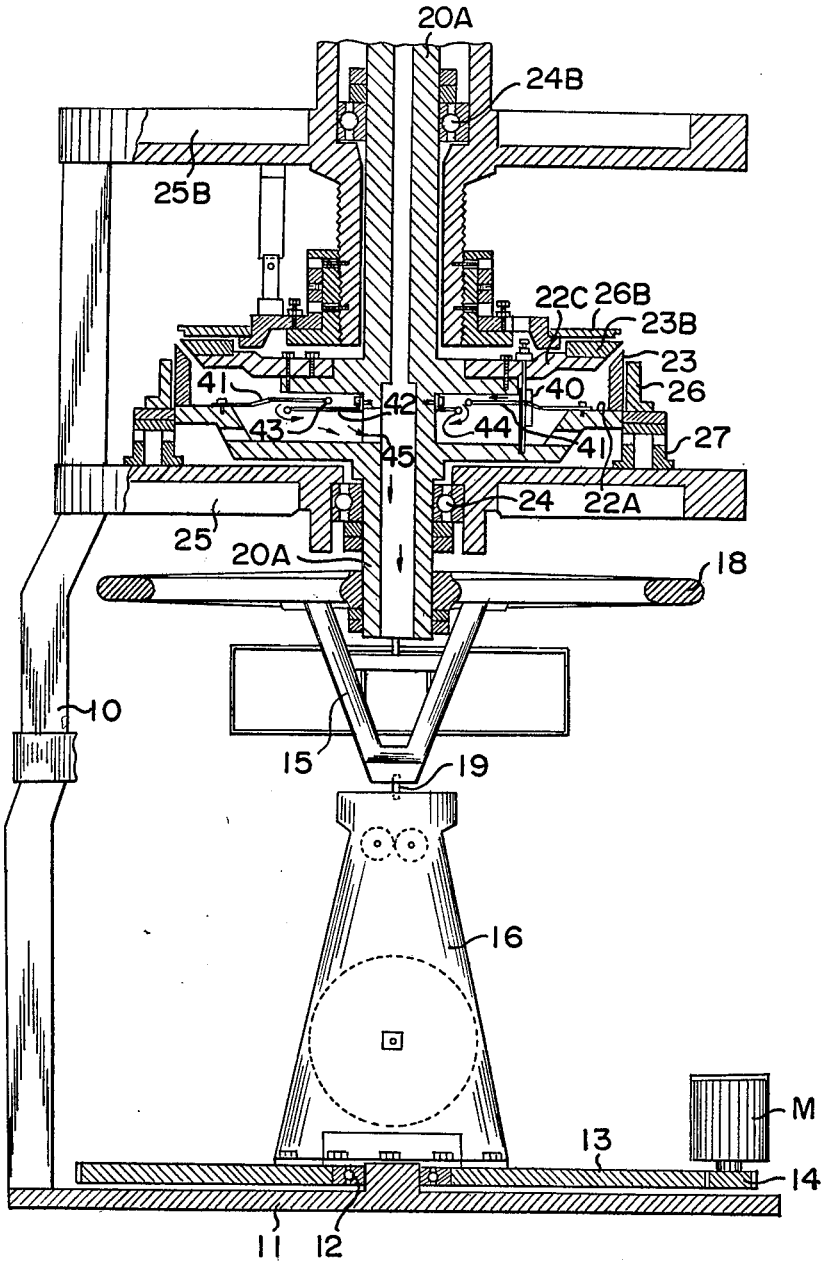
FIG. 3 is a longitudinal cross-sectional view through a third embodiment of the invention.

FIGS. 3 and 4 refers to a third embodiment of the invention, which is an interlock circular knitting machine employing a single shaft, wherein the input of mechanical power is provided on the base 11 of a machine truss 10. As shown in FIG. 3, the mechanical power produced by a motor M is transmitted sequentially through a pinion 14, a gear wheel 13, a lower driving bracket 16, an upper driving bracket 15 to a transmission ring 18. The transmission way of the third embodiment is similar to that of the first embodiment, except that they are respectively employed in two different kinds of circular knitting machine. Said transmission ring 18 is rigidly fixed on to beneath a comparatively long central hollow shaft 20A which is rotationally supported within the central holes of a lower machine plate 25 and an upper machine plate 25B respectively by means of a bearing 24 and another bearing 24B. Between said upper machine plate and said lower machine plate, an upper circular latch needle plate 22C and a lower circular latch needle plate 22A are secured on to the middle portion of said central hollow shaft 20A. Upon the outer circumference of said upper circular latch needle plate 22C, a plurality of latch needles 23B—23B are provided, while upon the outer circumference of said lower circular latch needle plate 22A, also provided are a plurality of latch needles 23—23. Furthermore, between said upper circular latch needle plate 22C and said lower circular latch needle plate 22A, a plurality of supporting bars 42—42 are secured on to said central hollow shaft 20A, at the ends of which a lower adjusting steel ring 44 is horizontally secured. And upon said lower circular latch needle plate 22A, still a plurality of supporting bars 41—41 are secured, at the ends of which an upper distance adjusting steel ring 43 is horizontally fixed. Said upper distance adjusting steel ring 43 which is a regular circle and said central hollow shaft 20A are concentric, while said lower distance adjusting steel ring 44 which is an unregular circle but symmetrical to the supporting bars 41—41 and said hollow shaft are eccentric. As seen in FIGS. 3 and 4, a knife 40 for cutting knitted fabric is provided between said upper circular latch needle plate 43 and said lower circular latch needle plate 44 whereby knitted cylinder-like fabric is cut as flat one. And opposite to said knife 43, a fabric outlet 45 is provided upon said central hollow shaft 20A. In operation, the fabric flows from the knitting position, and afterwards passes through knife 40, then to the inner rim of said upper ring 43, the outer rim of said lower ring 44, and finally to said fabric outlet 45. In order to equalize the strain force on every vertical line of fabric, namely, the vertical lines between every needle position and fabric outlet which vertical lines are equal in the time of fabric flowing, said lower distance adjusting steel ring 44 is thus constructed with a symmetrical axis 41—41 in cooperation with said upper distance adjusting steel ring 43.

To further clarify, as the arrows show in FIGS. 3 and 4, when the knitted fabric is cut up by means of said knife 40, it will pass forward through equal distances no matter from what tangential point of the circumference of said upper distance adjusting steel ring 43 to said fabric outlet 45 wherefrom it is drained out. Since the third embodiment thereof has the provision of the upper and lower circular latch needle plates securedly on to a central line, the revolving as a result is precisive.

The third embodiment shares the same effect with the first and second embodiments in the damping and counterpoising of oscillation, having the features that the power transmission distance is lengthened for the purpose of reducing the violent oscillation occurred from the power source, and that the oscillation transmitted from any oscillation starting points to the central hollow shaft is radially distributed to each latch needle whereby the undesired horizontal line conventionally occurring in the knitted fabric is obviated.

Figure 5:
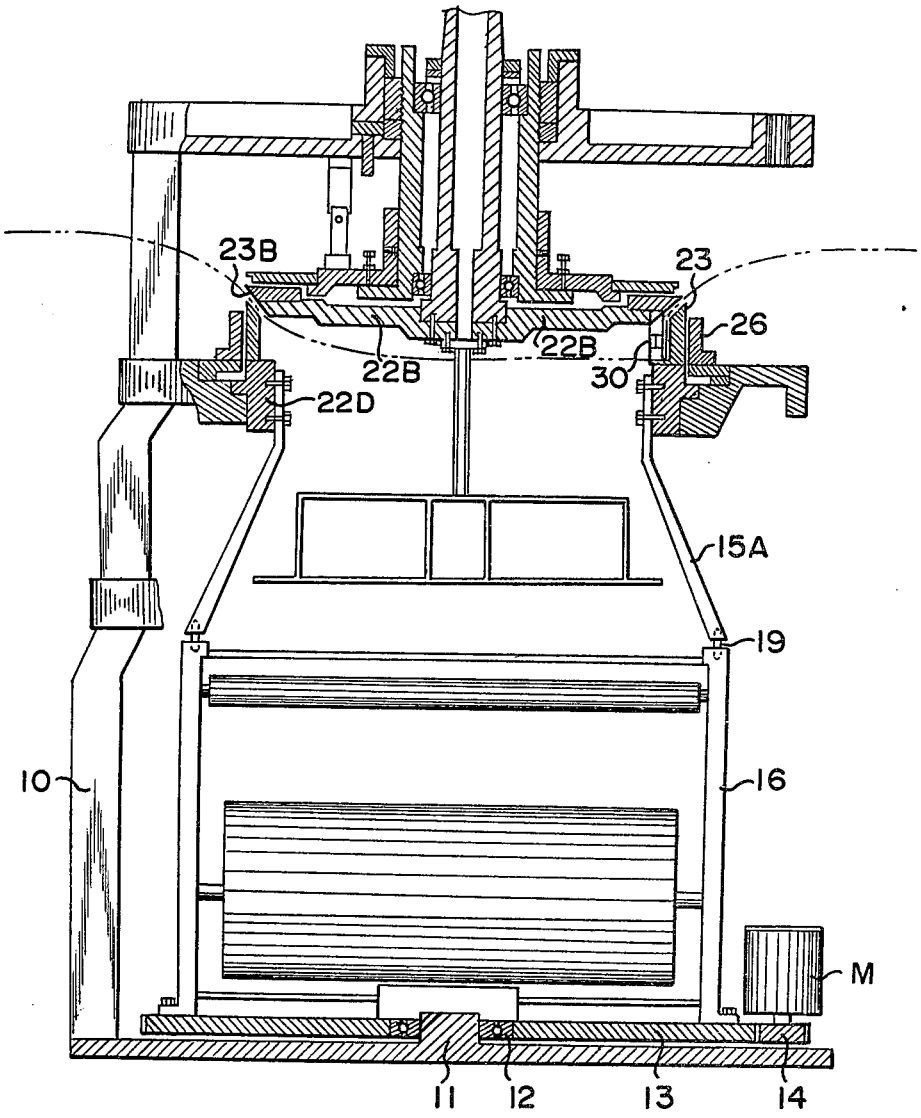
FIG. 5 is a longitudinal cross-sectional view through a fourth and fifth embodiment of the invention, wherein the former is the portion under the phantom line, while the latter includes the portions under and above the phantom line.

The portion under the phantom line in FIG. 5 depicts a fourth embodiment of the invention, which is a single circular knitting machine without the provision of central shaft. The transmission line of the present embodiment is no other than those of said first and second embodiments, except that the former one has the provision of an upper driving bracket 15A, the upper ends of which are secured on to the inner side of a circular latch needle plate 22D without central shaft, said circular latch needle plate 22D having the provision of a plurality of latch needles therein. Said circular latch needle plate 22D derives its mechanical power from a motor M, the mechanical power passing through a pinion 14, a gear wheel 13, a lower driving bracket 16, an upper driving bracket 15A and finally to said circular latch needle plate 22D. Since the oscillation derived from between said pinion 14 and said gear wheel 13 is transmitted through a long dredging distance to the latch needles, the oscillation can be decreased to the least extent and meantime equally distributed upon each latch needle whereby the undesired horizontal line is prevented.

FIG. 5 inclusively of portions under and above the phantom line indicates a fifth embodiment of the invention, which is an interlock circular knitting machine with single shaft in the upper portion thereof and with no provision of central shaft thereunder. The fifth embodiment is no other than the fourth one, except that the former has the provision of a bearing transmission line 30 between a lower circular latch needle plate 23 and an upper circular latch needle plate 23B whereby said lower and upper circular latch needle plates rotate synchronously.

Figure 6:
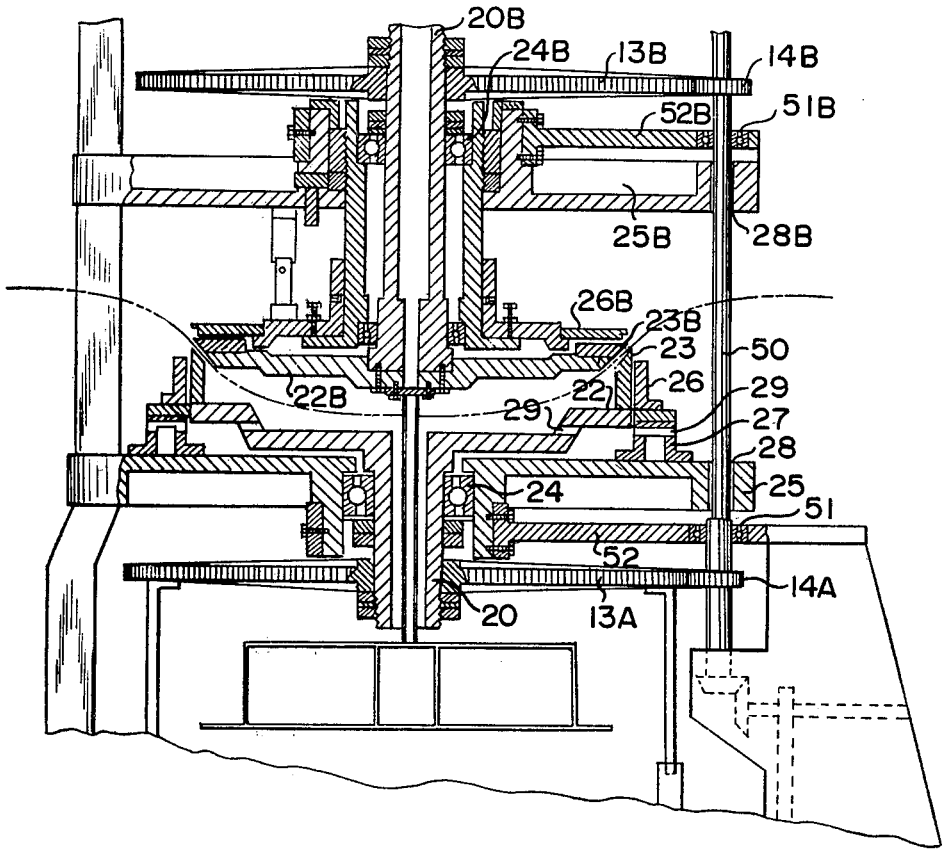
FIG. 6 is a longitudinal cross-sectional view through a sixth and seventh embodiment of the invention, wherein the former is the portion under the phantom line, while the latter includes the portions under and above the phantom line.
Figure 7:
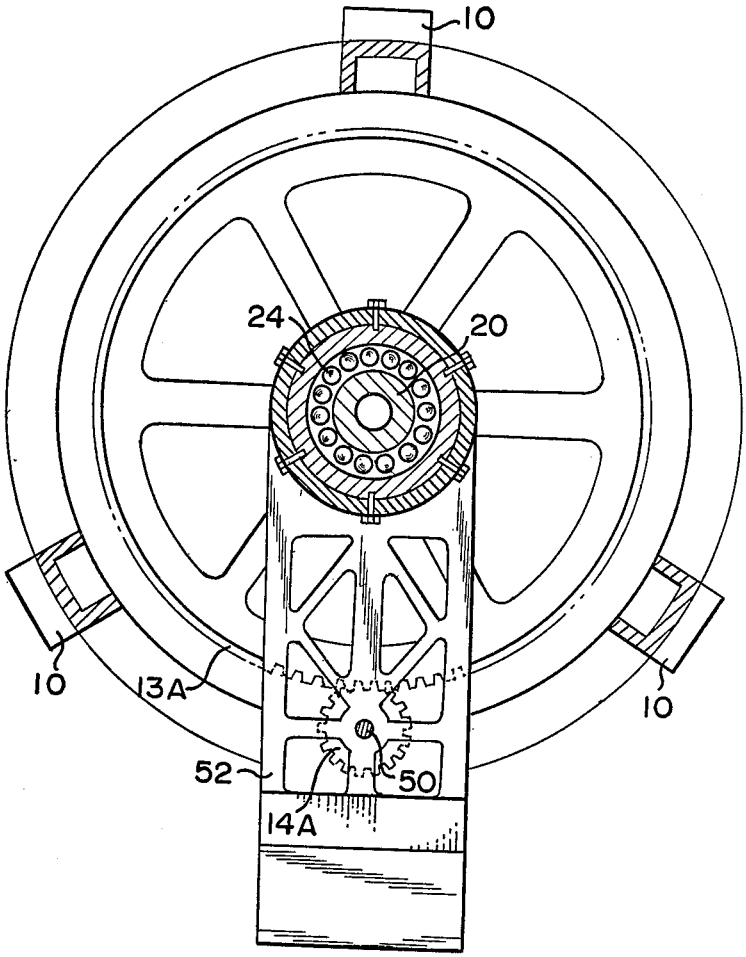
FIG. 7 is a top view of an oscillation dredging plate provided in said sixth and seventh embodiment of the invention.

The portion under the phantom line in FIG. 6 show a sixth embodiment of the invention, which is a single knitting machine with single shaft. The present embodiment has the provision of a machine plate 25, and a gear wheel 13A, the former being connected to a central hollow shaft 20, by means of a bearing 24 while the latter being secured on to said central hollow shaft 20. As shown in FIG. 6, an oscillation damping plate 52 between said machine plate 25 and said gear wheel 13A is fixed on to the hub of said machine plate 25. Furthermore, a lateral driving shaft 50 with pinion 14A at the lower portion thereof to engage with said gear wheel 13A extends through a bearing 51 of said oscillation dredging plate 52 and a loose hole 28 of said oscillation machine plate 25. Said driving shaft 50 is vertically provided along a tangential line approximately to the curve of said gear wheel 13A. Said loose hole 28 is large enough to permit the extension of said driving shaft 50 therethrough and has no physical contact therebetween. As shown in FIG. 6, a circular latch needle plate is referred as 22, upon which a plurality of latch needles 23—23 are provided. Upon said machine plate 25, a cam seat 27 is provided to install cams 26—26 thereupon. Besides, the present embodiment thereof has the provision of an inspection space 29 between the upper rim and lower hub of said circular latch needle plate 22. The oscillation of the present embodiment derived from between said pinion 14A and gear wheel 13A passes through said driving shaft 50, said oscillation damping plate 52 and said machine plate 25, resulting in that it is decreased and meantime dispersed equally upon each latch needle.

All the portions inclusively of those under and above the phantom line is the seventh embodiment of the invention, which is an interlock circular knitting machine with double shafts. A lateral driving shaft 50 which extends through a loose hole 28 of a machine plate 25 extends upwards through another loose hole 28B of an upper machine plate 25B and further upwards through a bearing of an upper oscillation damping plate 52B, said machine plate 25B being connected to an upper central hollow shaft 20B by means of a bearing 24B. As shown in FIG. 6, said upper oscillation damping plate 52B is horizontally secured on to the hub of said upper machine plate 25B. Secured at the upper free end of said lateral driving shaft 50 is a pinion 14B to engage with a gear wheel 13B which is secured on to the upper end of said upper central hollow shaft and is located above said upper oscillation dredging plate 52B. The present embodiment has further a circular latch needle plate 22B at the lower portion of said upper central hollow shaft 20B to be installed with a plurality of latch needles 23B—23B and cams 26B above said latch needles 23B—23B whereby when said two pinions 14A and 14B are drived to rotate, two sets of the upper and lower knitting assembly will rotate sychronously.

Figure 8:
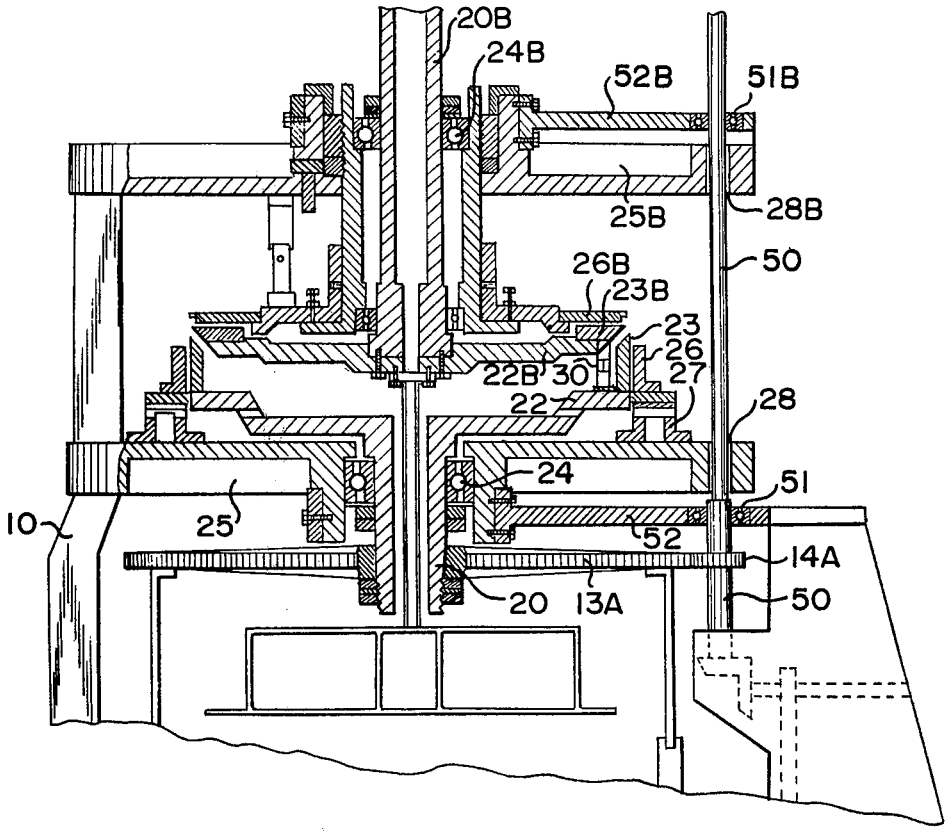
FIG. 8 is a longitudinal cross-sectional view to depict an eighth embodiment of the invention.

FIG. 8 shows an eighth embodiment of the invention, which is a bearing transmission typed interlock circular knitting machine with double shafts. The eighth embodiment is similar to said seventh embodiment thereof, except that the former one is provided with only one pinion 14A to engage with a gear wheel 13A which is secured on to a central hollow shaft 20, a bearing transmission line between an upper circular latch needle plate 23B and the circular latch needle plate 23 at the lower portion thereof whereby the upper and lower knitting assembly as a result rotate sychronously.

Figure 9:
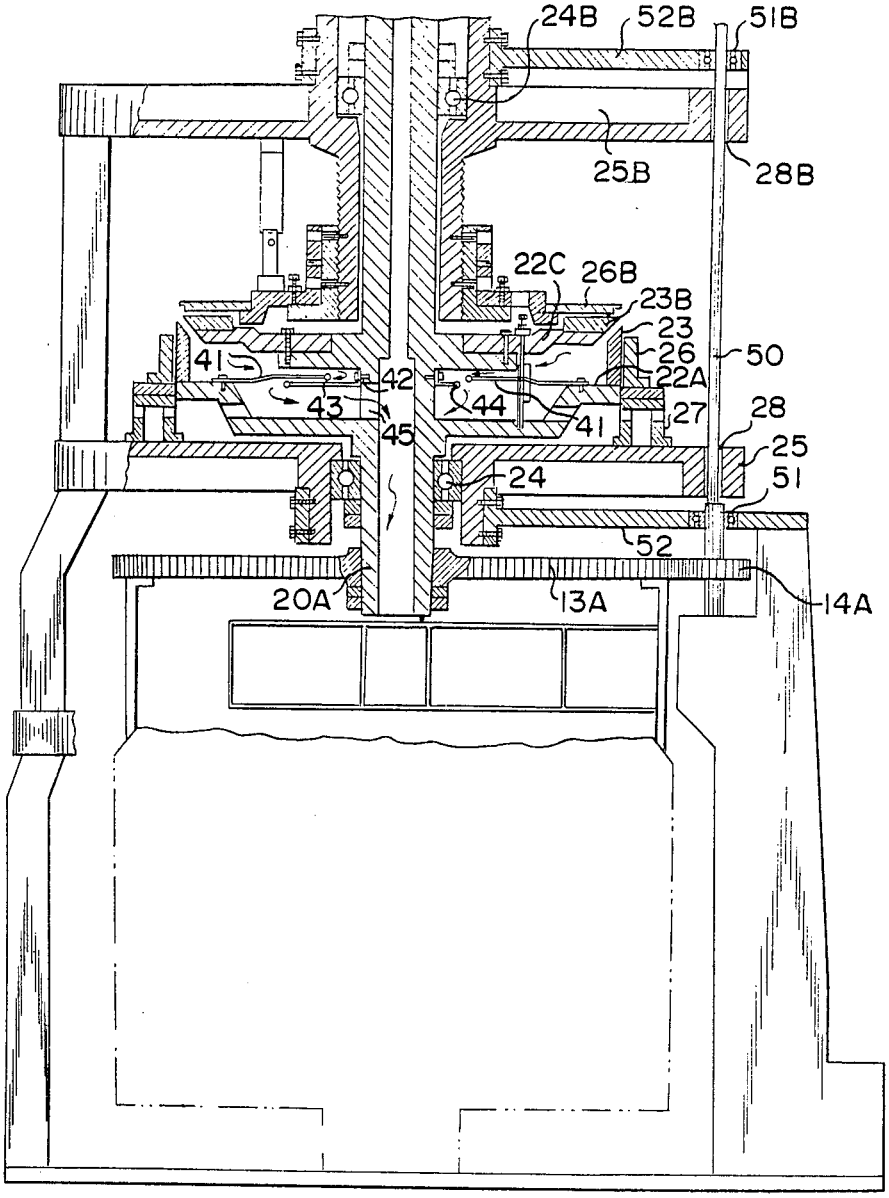
FIG. 9 is a longitudinal cross-sectional view to depict a ninth embodiment of the invention.

FIG. 9 shows a ninth embodiment of the invention, which is an interlock circular knitting machine with single shaft. Comparatively saying, the present embodiment is different from said third embodiment. As shown in FIG. 9, a gear wheel 13A is secured on to the lower portion of a central hollow shaft 20A above the cloth roll. And a lateral driving shaft 50 is thus provided in the present embodiment that it extends through the loose hole 28 of the machine plate 25 and upwards through the loose hole 28B of the upper machine plate 25B. Besides, said driving shaft 50 extends also through the lower and upper oscillation damping plates 52 and 52B by means of a bearing 51 and another bearing 51B. A pinion 14A is fixed on to the lower portion of said lateral driving shaft 50 to engage with a gear wheel 13A which is secured on to said central hollow shaft 20A. The mechanical power derived from a motor M is transmitted sequentially through said pinion 14A, said gear wheel 13A, said central hollow shaft 20A whereby said upper and lower latch needle shafts are driven to sychronously proceed knitting. As a result, the present invention has likewise a good effect of oscillation damping and oscillation counterpoising.

The inventor has made a series of experiments upon said embodiments 6, 7, 8 and 9. Taking a circular latch needle plate of 30 inches in diameter as an example, the results of the experiments indicate that the distance from the starting point of oscillation upon the teeth of the pinion, through the gear wheel 13A, the central hollow shaft 20 the lower circular latch needle plate 22 to the tip of any latch needle is about 1,000 mm, and that the distance extending from the lower bearing 51, through the lower oscillation dredging plate 52, the lower cam seat 27, the lower cams 26, to the tip of any latch needle is also about 1,000 mm. Since the oscillation dredging distance of said embodiments 6–9 is about 3–5 times of that of the conventional arts, it is obvious that the oscillation can be greatly decreased and meantime equally dispersed upon any latch needle whereby the undesired horizontal line is effectively prevented.

The oscillation dredging distance of said embodiments 1, 2, 3, 4 and 5 is longer than that of said embodiments 6, 7, 8 and 9. Therefore, said embodiments 1–5 have greater effect in oscillation damping and oscillation counterpoising.

The gear wheel 13 or 13A of each embodiment as disclosed hereinabove is employed to transmit mechanical power. And whenever necessary, the belt pulley can be alternately employed to replace it.

Furthermore, since such means as sinker plate and sinker cams which are required to push down the knitted fabric in the single circular knitting machine have nothing to do with the invention, they do not appear in the accompanying drawing and have not been mentioned.

I claim:

1. An oscillation damping and counterpoising single circular knitting machine with single shaft comprising:
- a base;
- a machine truss;
- an active central hollow shaft and a passive central hollow shaft which are mounted within the central portion of said machine truss;
- a gear wheel which is provided upon the base which is secured on the lowermost end of said machine truss;
- a pinion in mesh with said gear wheel, which derives its mechanical power from a motor;
- a transmission ring which is secured on the lowermost end of said active central hollow shaft;
- a lower driving bracket which is secured on said gear wheel;
- an upper driving bracket which connects with said lower driving bracket by means of movable pins and is secured on said transmission ring;
- an upper circular latch needle plate which is secured on said passive central hollow shaft;
- a lower circular latch needle plate secured to said active central hollow shaft and having a lower hub and an upper rim;
- a plurality of latch needles which are provided on said lower circular latch needle plate;
- a bearing transmission assembly provided between said upper circular latch needle plate and said lower circular latch needle plate, said bearing transmission assembly comprising two transmission bearings which are respectively pivoted upon two eccentric axes, a driving bearing and a braking bearing which are respectively provided at the outer sides of the former two bearings such that the lower and upper circular latch needle plates can rotate synchronously;
- a cam seat which is provided upon the outer circumference of said circular latch needle plate;
- cams which are provided upon said cam seat;
- an inspection space which is provided through between the lower hub and the upper rim of said lower circular latch needle plate and through between said cams and said cam seat; and
- being characteristic in that the oscillation occurring between said gear wheel and said pinion passes to the tip of each latch needle whereby the oscillation is radially dispersed to each latch needle and meantime greatly decreased.

2. An oscillation damping and counterpoising interlock circular knitting machine according to claim 1, wherein said passive central hollow shaft is provided at the upper portion of said machine.

* * * * *